US005433539A

United States Patent [19]

German

[11] Patent Number: 5,433,539

[45] Date of Patent: Jul. 18, 1995

[54] CONTROL OF MEDIA MOVEMENT USING A PERIODIC CALIBRATION METHOD AND APPARATUS

[75] Inventor: Trevor J. German, Waterloo, Canada

[73] Assignee: NCR Corporation, Dayton, Ohio

[21] Appl. No.: 7,643

[22] Filed: Jan. 21, 1993

[51] Int. Cl.[6] ..... B41J 33/10

[52] U.S. Cl. ..... 400/225; 400/234; 400/236; 242/421.4

[58] Field of Search ..... 400/225, 235, 234, 219, 400/219.1, 236; 242/75.47, 75.5, 75.51

[56] References Cited

U.S. PATENT DOCUMENTS

| | | | |
|---|---|---|---|
| 4,177,731 | 12/1979 | Kliest et al. | 400/219.1 |
| 4,475,829 | 10/1984 | Goff, Jr. et al. | 400/232 |
| 4,573,645 | 3/1986 | Harris, Sr. | 242/75.47 |
| 4,687,359 | 8/1987 | Barrus et al. | 400/225 |
| 4,698,507 | 10/1987 | Gottwald et al. | 400/225 |
| 4,712,113 | 12/1987 | Brooks et al. | 400/232 |
| 4,739,950 | 4/1989 | Goker et al. | 242/203 |
| 4,878,773 | 11/1989 | Mazumder | 400/234 |
| 5,117,241 | 5/1992 | Stephenson | 400/225 |
| 5,162,815 | 11/1992 | Hodge | 400/225 |

*Primary Examiner*—Edgar S. Burr
*Assistant Examiner*—John S. Hilten
*Attorney, Agent, or Firm*—Elmer Wargo

[57] ABSTRACT

A ribbon supply apparatus including a support in which a ribbon supply spool and a take-up spool are rotatably mounted. The supply and take-up spools and the support are designed so that these spools can be mounted in the support in only one way, the correct way. The ribbon is supplied on a tubular core member which is mounted on a cylindrical member which is part of the supply spool. The ribbon supply spool has a large gear thereon which is used in a braking and feeding mechanism which is used to incrementally feed the ribbon to a print station associated with the apparatus. The ribbon take-up spool is identical to the ribbon supply spool, but the ribbon take-up spool is mounted in a reversed manner when compared to the ribbon supply spool. A driving gear, coupled to the large gear on the take-up spool is part of the braking and feeding mechanism which also includes a "dancer arm". The dancer arm controls a loop of ribbon which is fed to the print station. A velocity sensor (including a roller and a timing disc) is positioned between the print station and the take-up spool and is used in providing a measure of the velocity of the ribbon being moved from the print station. Outputs from the timing disc are used in determining the number of steps which a stepping motor driving the take-up spool must be incremented by a controller to move a predetermined amount of ribbon to the print station.

10 Claims, 5 Drawing Sheets

CONTROL OF MEDIA MOVEMENT USING A PERIODIC CALIBRATION METHOD AND APPARATUS

BACKGROUND OF THE INVENTION

1. Field of Invention

This invention relates to a method and apparatus for feeding media from a roll, for a calibrated distance, to a work station.

2. Background Information

In certain applications, it is necessary to transport media (like paper, magnetic tape, or inked ribbons, for example) a fixed distance from a supply spool, on which the media is wound into a roll, to a work station. From the work station, the media is transported to a take-up spool on which the media is wound. As the media is used, the diameter of the media on the supply spool gets smaller while the diameter of the media on the take-up spool gets larger. In such a situation, the rotational motion of the supply spool and the take-up spool will vary depending upon how much media there is on each one of these spools. In such a situation, it is not appropriate to move the take-up spool through a fixed rotational angle to move the media a fixed distance at the work station.

There are three general methods of solving the problem presented in the previous paragraph. These methods are:

1. Drive the media;
2. Use a metering roller on the media; or
3. Drive the take-up spool through varying angles according to the spool diameter.

The first method presented above is useful for media which is narrow because wide media does not track well with this method. It is also undesirable to use a pinch roller on printing media because one or both of the rollers in the associated capstan-pinch roller combination becomes contaminated with ink, resulting in operation failure.

The second method presented above places a roller arrangement in the path of the media. The media is deflected around the roller which turns as the media is advanced. This technique is generally adequate; however, it depends upon two factors. They are:

1. No slip between the media and the roller; and
2. The media motion has to be in phase with the drive.

The first limitation is usually the more critical. Very often, the media has a slippery side which contacts the roller; this makes the friction between the media and the roller hard to control; and consequently, feeding the media a fixed distance is difficult to control. The second limitation is more subtle. When driving the media, it is normal to accelerate the media until the media has moved through a certain distance and then decelerate the media. If there is a phase shift between the motor moving the media and the media itself, there will be an error in movement of the media. This is especially prevalent when a slotted cardboard core, on which the media is wound, is used.

The third method mentioned above, driving the take-up spool through varying distances, relies upon a fundamental assumption. That is, if the total volume of media on each of the supply and take-up rolls is known, then the relative turning arcs of each spool can be determined for any diameter of the take-up roll. For example, if the supply and the take-up spools are half full, then both these spools will turn the same amount for an increment of media to be supplied to a work station. By measuring the ratio of the number of steps moved by the take-up spool relative to the supply spool, the diameter of the media on the take-up spool can be calculated. This technique is applicable if, and only if, the following events apply:

1. The take-up tension (at the take-up spool) is the same as the supply tension (at the supply spool);
2. The total volume of the media is known; and
3. There is a direct coupling between the supply spool and the take-up spool.

This method is difficult to achieve because it is difficult to realize the above three events. For example, the tension is usually much higher at the take-up spool that it is at the supply spool. The media volume can change drastically, especially after media breakage. Generally, some sort of tensioning arm is used as an inertia-reducing element; this decouples the supply spool from the take-up spool.

SUMMARY OF THE INVENTION

An object of this invention is to provide a low cost and reliable method and apparatus for supplying a fixed amount of media to a work station, with the media coming from a supply spool (whose diameter gets smaller as the media is used) and for winding up the "used" media on a take-up spool (whose diameter gets larger as the media is collected thereon).

In a first aspect of this invention, there is provided an apparatus comprising:

a print station;

a ribbon supply means including a ribbon supply spool having ribbon wound thereon for supplying unused ribbon to said print station as ribbon is unwound from said ribbon supply spool;

a ribbon take-up means including a ribbon take-up spool for winding thereon ribbon supplied to said print station from said supply spool;

said ribbon take-up means comprising:

a stepping motor coupled to said take-up spool for rotating said take-up spool in stepped increments;

a velocity sensor positioned between said print station and said take-up spool for sensing the velocity of said ribbon as said ribbon is wound on said ribbon take-up spool by expressing the velocity of the ribbon as a time period T for an angular displacement; and processor means for dividing said time period T by a predetermined number N for providing a number of stepped increments to said stepping motor for rotating said take-up spool.

A second aspect of this invention relates to a method for use in an apparatus which includes:

a print station;

a ribbon supply means including a ribbon supply spool having ribbon wound thereon for supplying unused ribbon to said print station as ribbon is unwound from said ribbon supply spool; and a ribbon take-up means including a ribbon take-up spool for winding thereon ribbon supplied to said print station from said supply spool;

said method being used for providing equal increments of ribbon to said print station as the amount of ribbon on said ribbon supply spool gets smaller and correspondingly, the amount of ribbon on said ribbon take-up spool gets larger; said method comprising the steps of:

(a) using a stepping motor to incrementally rotate the ribbon take-up spool; and (b) using the velocity of said ribbon between said print station and said ribbon take-up spool as a result of step (a) to determine the number of steps required to index said stepping motor so as to present an equal increment of ribbon to said print station.

The above advantages, and others, will be more readily understood in connection with the following specification, claims, and drawing.

DETAILED DESCRIPTION OF THE PREFERRED EMBODIMENT

Figure 1:
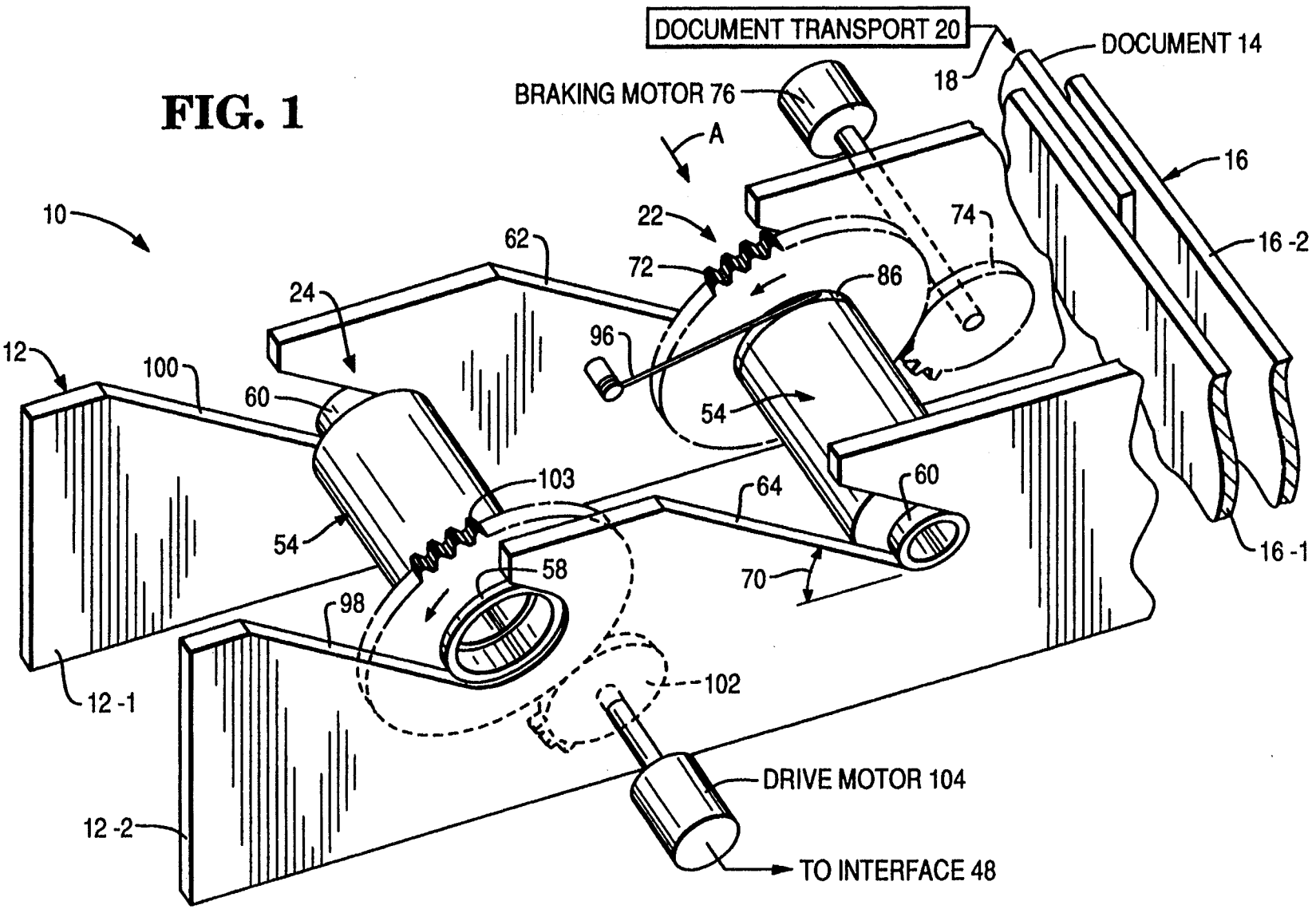
FIG. 1 is an isometric view of a ribbon supply apparatus made according to this invention, showing, among other elements, a ribbon supply spool and a ribbon take-up spool.

FIG. 1 shows a preferred embodiment of this invention which shows a media supply apparatus which is designated generally as apparatus 10. While the media may be paper, magnetic tape, or inking ribbons, for example, the particular embodiment selected to portray this invention relates to an inking ribbon. The apparatus 10 includes a support 12 which includes first and second side frames 12-1 and 12-2. The apparatus 10 may be used in a business machine like an encoder which is used to print or encode data on a document 14. The document 14 is moved in a document track 16, in a downstream direction, as shown by the direction of arrow 18, by a document transport 20, as is done conventionally. The document track 16 has upstanding side walls 16-1 and 16-2 and a track bottom 16-3, as shown in FIG. 2.

Figure 2:
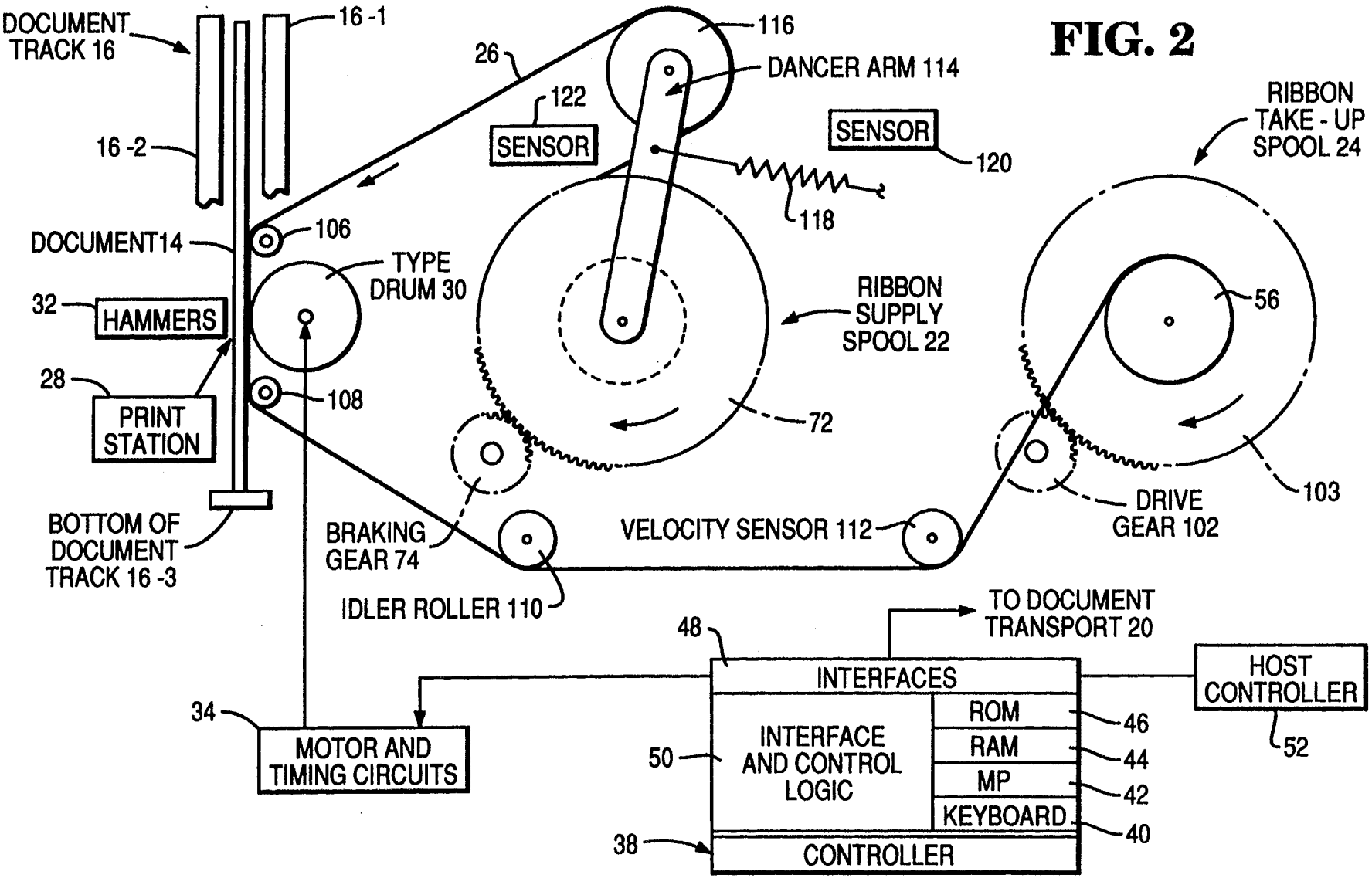
FIG. 2 is a schematic diagram, taken from the direction of arrow A of FIG. 1 to show additional elements of the apparatus shown in FIG. 1.
Figure 6:
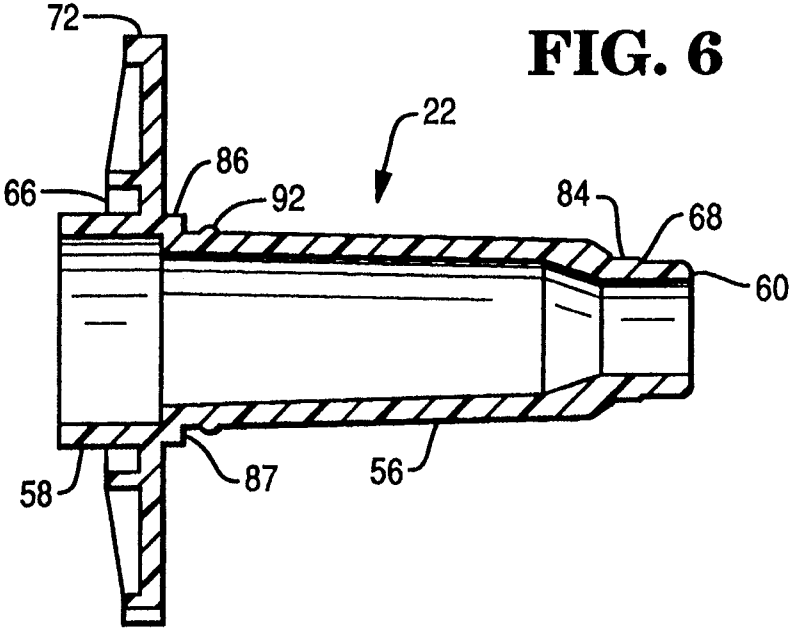
FIG. 6 is a cross sectional view of the ribbon supply spool shown in FIGS. 4 and 5, and is taken along the line 6—6 shown in FIG. 5.

FIGS. 1 and 2 are useful in explaining the general operation of the apparatus 10. The apparatus 10 includes a ribbon supply spool 22 and a ribbon take-up spool 24. Ribbon 26, from the supply spool 22 is fed to a print station 28 (FIG. 2) where a printer is used to print data on the document 14. In the embodiment described, the printer selected to portray the invention includes a type drum 30 and a plurality of hammers 32, although other types of printers, like thermal printers, could be used. The type drum 30 includes a plurality of type wheels, with one hammer 32 being provided for each type wheel included in the type drum 30. The upstanding sides 16-1 and 16-2 have suitable openings therein to enable the hammers 32 to impact the document 14 and the ribbon 26 against the type drum 30 as is conventionally done. There are the usual motor and timing circuits 34 to control the data which is printed on the document 14.

The apparatus 10 is controlled by a conventional controller 38 which has a keyboard 40, microprocessor (MP 42), RAM 44, ROM 46, and interfaces 48 which are all intercoupled by interface and control logic 50. The interfaces 48 represent the various conventional interfaces which are necessary to couple the controller 38 to the various elements in the apparatus 10 and to a host controller 52 where necessary or desirable.

Figure 3:
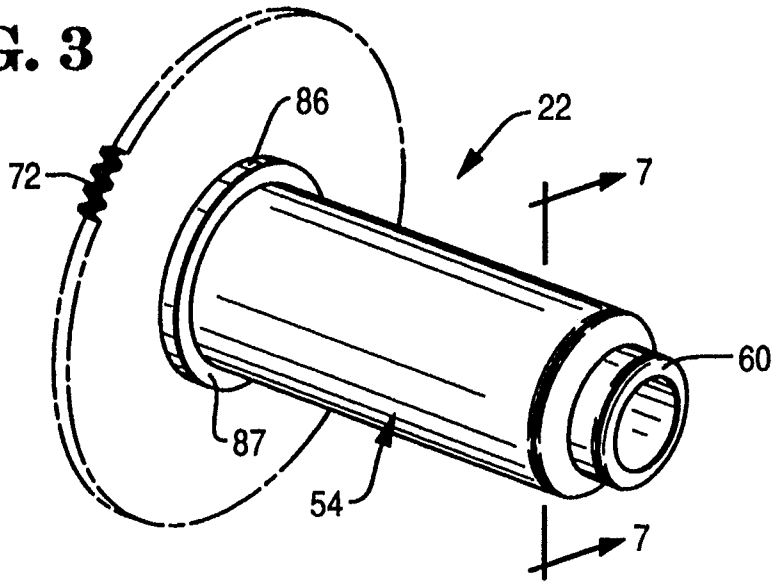
FIG. 3 (shown on the sheet with FIG. 6) is a general isometric view of the ribbon supply spool shown in FIG. 1, with a tubular core member thereon, but with the ribbon being removed from the supply spool.
Figure 8:
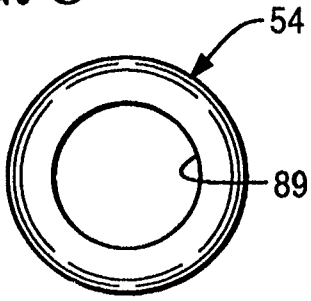
FIG. 8 is a right end view of the tubular core member shown in FIG. 7.
Figure 9:
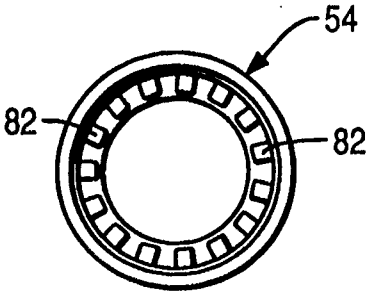
FIG. 9 is a left end view of the tubular core member shown in FIG. 7.

The ribbon supply spool 22, alluded to earlier herein, is shown in more detail in FIGS. 3, 4, 5, and 6. FIG. 3 shows the ribbon supply spool 22 with a tubular core member 54 being mounted thereon, with the tubular core member being shown in more detail in FIGS. 7, 8, and 9.

Figure 4:
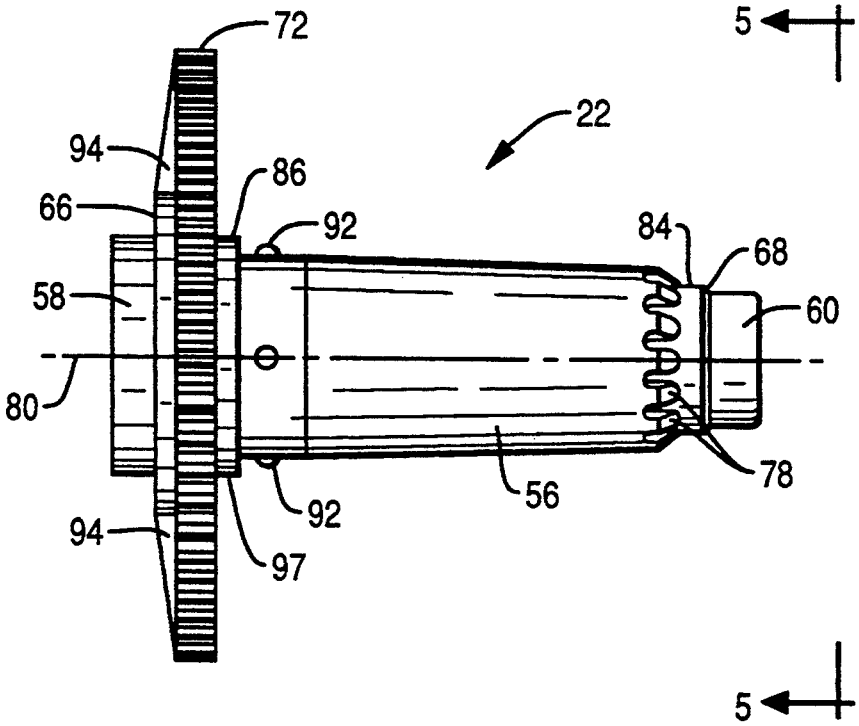
FIG. 4 is a side view, in elevation, of the ribbon supply spool shown in FIG. 3, with the tubular member being removed therefrom.
Figure 5:
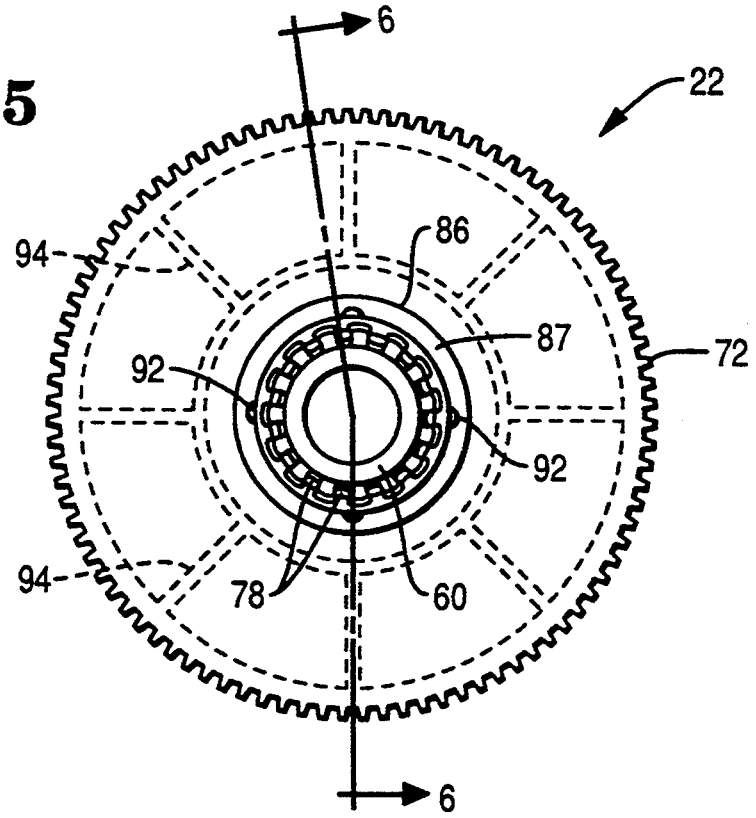
FIG. 5 is a right end view of the ribbon supply spool shown in FIG. 4.

The ribbon supply spool 22 has a generally cylindrical member 56 which has a large bearing or support portion 58 at one end thereof and a small bearing or support portion 60 at the remaining end thereof, as shown best in FIGS. 4 and 5. The first side frame 12-1 has a first slot or wide slot 62 (FIG. 1) to receive the large support portion 62 and also has a second or narrow slot 64 to receive the small support portion 60. This construction ensures that the ribbon supply spool 22 is loaded correctly in the support 12. The first and second side frames 12-1 and 12-2 are spaced apart so as to enable a shoulder 66 on the ribbon supply spool 22 to abut against the first side frame 12-1 and to enable an annular shoulder 68 near the small support portion 60 to abut against the second side frame 12-2 so as to restrain the ribbon supply spool 22 against axial movement within the support 12. The first and second slots 62 and 64 are positioned at an angle of 60 degrees relative to a horizontal line (as shown by double arrow 70 in FIG. 1); this type of construction enables the ribbon supply spool 22, with a supply of ribbon thereon, to be moved to its operating position shown in FIG. 1 without interfering with other elements in the machine in which the apparatus 10 is located. The ribbon which is used in the apparatus 10 is wound on the tubular core member 54 when received at the apparatus 10. The tubular core member 54 is positioned on the cylindrical member 56 of the ribbon supply reel 22 prior to moving the ribbon supply spool 22 into the position shown in FIG. 1.

Continuing with a description of the ribbon supply spool 22, shown in FIGS. 3–6, this construction also has an external gear 72 located near the large support portion 58. When the ribbon supply spool 22 is in the operating position shown in FIG. 1, the external gear 72 meshes with a braking gear 74. The braking gear 74 is coupled to a braking motor 76, which is controlled by the controller 38, as will be described hereinafter. Essentially, the breaking gear 74 and the braking motor 76 keep the ribbon supply spool 22 from rotating.

As seen from FIG. 4, the generally cylindrical member 56 of the ribbon supply spool 22 is slightly tapered, being narrower at the end containing the small support portion 60. This construction facilitates the fabrication of the ribbon supply spool 22 and also facilitates the loading of the tubular core member 54, with the ribbon 26 thereon, on to the cylindrical member 56. The cylindrical member 56 also has a plurality of teeth 78 thereon, with these teeth 78 being aligned parallel to the longitudinal axis 80 of the ribbon supply spool 22. In the embodiment described, the plurality of teeth 78 are spaced 24 degrees apart. These external teeth 78 mesh with complementary teeth 82 located near a partially closed end 84 of the tubular core member 54, as shown best in FIG. 9. The teeth 82 are also spaced 24 degrees apart. One of the features of this invention is that because there are 24 teeth 78 (a large number) on the cylindrical member 56 and a matching number on the tubular core member 54, these two members do not have to be rotated very far, relative to each other, to enable the teeth 78 and 82 to mesh with one another and to enable the tubular core member 54, with the ribbon thereon, to be mounted on the ribbon supply spool 22. The ribbon supply spool 22 also has an annular bearing surface 84 (FIG. 4) which is located in an annular recess 89 (FIG. 7) of the tubular core member 54 when these two members are coupled together as previously described. The ribbon supply spool 22 also has an annular shoulder 87 against which the open end 88 (FIG. 7) of the tubular core member abuts when in the assembled relationship shown in FIG. 1.

Figure 7:
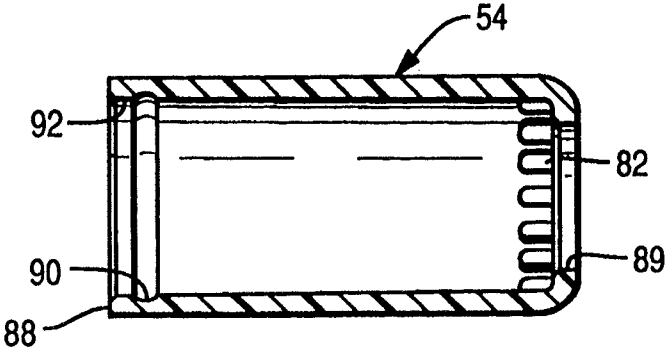
FIG. 7 is a cross sectional view of the tubular core member shown in FIG. 3, with this view being taken along the line 7—7 of FIG. 3.

The tubular core member 54 has an annular recess 90 therein and an annular detent 92 as shown in FIG. 7. The ribbon supply spool 22 has several projections, like 92 shown in FIG. 4, positioned around the circumference of the cylindrical member 56 to cooperate with the annular detent 92 to detachably hold the tubular core member 54 on the cylindrical member 56.

The ribbon supply spool 22 also has some radially aligned stiffeners or ribs 94 which provide strength thereto. In the embodiment described, the ribbon supply spool 22 is made of a plastic material, like nylon 6/6 with 20% PTFE; this material is self lubricating. The tubular core member 54 is made of ABS, a plastic material.

Naturally, the bottoms of the slots 62 and 64, shown in FIG. 1, are arcuately shaped to rotatably support the large support portion 58 and the small support portion 60 and to maintain the longitudinal axis 80 of the ribbon supply spool 22 in a horizontal position in the embodiment described. The ribbon supply spool 22, with a supply of ribbon 26 thereon, is maintained in the position shown in FIG. 1 by gravity and a spring clip which is shown, schematically, as a spring loaded wire 96. The wire 96 biases the ribbon supply spool 22 in a downward direction and to the left, as viewed in FIG. 1. The wire 96 may be pulled out of position during loading of the ribbon 26 on the supply spool 22, and it may be positioned on the annular shoulder 86 after the ribbon supply spool 22 is in the position shown in FIG. 1.

While this discussion has proceeded with respect to the ribbon supply spool 22, the ribbon take-up spool 24 is identical to the ribbon supply spool 22; consequently, a detailed discussion of the take-up spool 24 is not deemed necessary. An important difference relates to the way that the ribbon take-up spool 24 is positioned in the support 12. In this regard, the large support portion 58 of the take-up spool 24 is mounted in a slot 98 in the second side frame 12-2 and the small support portion 60 is mounted in a slot in the side frame 12-1, as shown in FIG. 1. The external gear 103 of the take-up spool 24 is in mesh with a driving gear 102 which is rotated by a drive motor 104 which is controlled by the controller 38. The external gears 72 and 103 of the ribbon supply spool 22 and the ribbon take-up spool 24 are located on opposed sides of the support 12 when properly positioned in the support 12 as shown in FIG. 1.

FIG. 2 is a schematic diagram showing how the ribbon supply apparatus 10 works. In this regard, the ribbon 26 is wound on the tubular core member 54 so that the ribbon 26 unwinds from the ribbon supply spool 22 in the direction shown in FIG. 2. The ribbon 26 rides over rollers 106 and 108 at the print station 28 to provide some clearance for the type drum 30 to rotate without contacting the ribbon 26 until actual printing takes place by energizing the print hammers 32. An idler roller 110 is used to route the ribbon 26 from the print station 28 to a velocity sensor 112, and thereafter, the ribbon 26 is wound on the tubular core member 56 of the take-up spool 24 in the direction shown. The general function of the velocity sensor 112 is to cooperate with the drive motor 104 to ensure that a prescribed amount of ribbon 26 is supplied to the print station 28 for each cycle of printing which is effected. This aspect will be discussed in more detail hereinafter, The overall operation of the ribbon supply apparatus 10 is as follows. The apparatus 10 includes a dancer arm 114 which has one end pivotally mounted in the support 12 and the remaining end thereof pivotally supporting a roller 116 as shown. The roller 116 has an axial length which supports the entire width of the ribbon 26. The dancer arm is biased in a clockwise direction, as viewed in FIG. 2, by a tension spring 118. When a fresh supply of ribbon 26 is to be supplied to the print station 28, the controller 38, through its associated software stored in the ROM 46 or RAM 44, will "unlock" the braking motor 76 and the braking gear 74, permitting the dancer arm 114 to be pivoted in a clockwise direction (by the spring 118) to unwind some ribbon 26 from the ribbon supply spool 22. As the dancer arm 114 pivots in a clockwise direction (FIG. 1), it approaches a positional sensor 120 which is coupled to the controller 38 via the interfaces 48, and the controller 38 actuates the braking motor 76 which prevents further rotation of the ribbon supply spool 22. Thereafter, the controller 38 energizes the drive motor 104 to feed the necessary amount of ribbon 26 to the print station 28 as required by the printing demands of a document 14 at the print station 28. As the ribbon 26 is fed in the required increments to the print station 28, the dancer arm 114 pivots in a counterclockwise direction against the bias of the tension spring 118 until the dancer arm 114 approaches a positional sensor 122 which is coupled to the controller 38 via the interfaces 48. The controller 38 then deenergizes the braking motor 76, permitting the tension spring 118 to withdraw a new length of ribbon 26 as described.

When the ribbon 26 from the supply spool 22 is exhausted, the supply spool 22 is removed from the position shown in FIG. 1, and the empty tubular core member 54 is removed therefrom. A new tubular core member 54, with a new supply of ribbon thereon, is inserted on the ribbon supply spool 22 as previously explained. The used ribbon 26 is then removed from the ribbon take-up spool 24, and the "empty" tubular core member 54 from the ribbon supply spool 22 is then mounted on the ribbon take-up spool 24, and this spool 24 is then mounted in the apparatus 10. The core member 54 may be made of different colored plastic to indicate the type of ribbon wound thereon.

Having described how the hardware shown in FIGS. 1 and 2 operates, it now seem appropriate to describe the method of determining the appropriate take-up distance that the take-up spool 24 must be incremented in order to feed a predetermined amount of ribbon 26 to the print station 28. The distance that the ribbon 26 is fed is expressed as a number of increments which the motor 104 (which is a stepping motor) must be incremented for changing diameters of ribbon 26 on the ribbon supply spool 22 and the ribbon take-up spool 24. The ribbon 26 has to be incremented enough to make sure that a clean printing results, and the incrementing should not be excessive to the point of wasting ribbon 26.

A point to mention here is that the drive motor 104 always indexes the ribbon 26 at the same angular velocity. The function of the velocity sensor 112 is to determine the velocity of the ribbon as it is pulled by the ribbon take-up spool 24. The velocity sensor 112 is shown schematically in FIG. 10.

Figure 10:
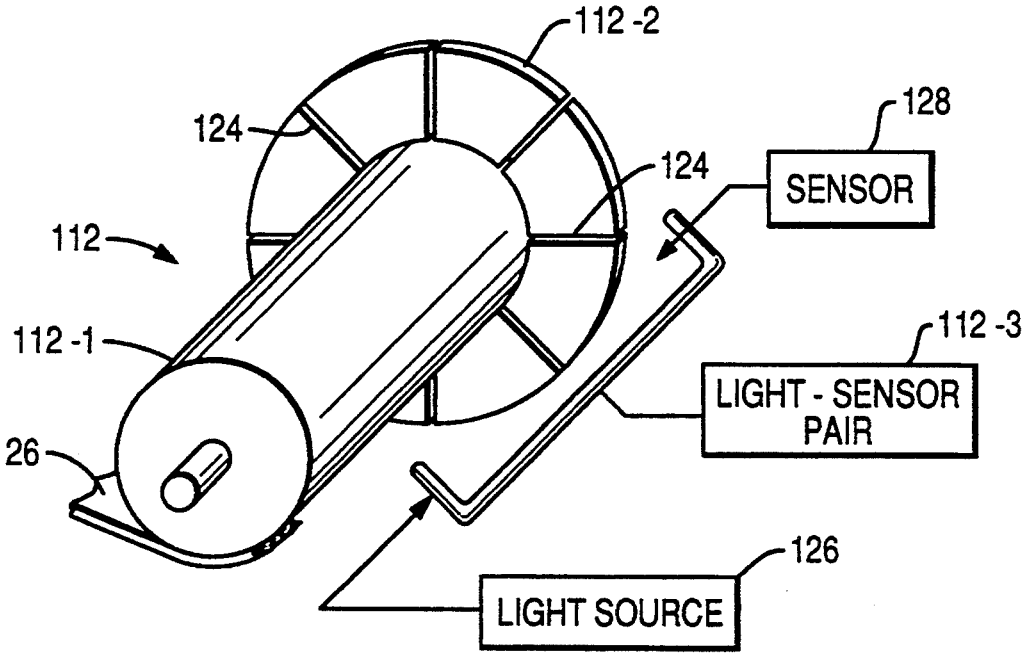
FIG. 10 is a diagrammatic view of the velocity sensor shown in FIG. 1.

The velocity sensor 112 includes a roller 112-1, a timing disc 112-2, and a light sensor pair 112-3, as shown in FIG. 10. A portion of the ribbon 26 is shown in contact with the roller 112-1 which has a width to accommodate the width of the ribbon 26. The timing disc 112-2 is fixed to the roller 112-1 to rotate therewith, and this disc is opaque except for clear, radially aligned slits or areas 124 therein. The light sensor pair 112-3 includes a light source 126 and an associated sensor 128 which are positioned on opposed sides of the timing disc 112-2. As the roller 112-1 rotates under the action of the ribbon 26, the timing disc 112-2, in cooperation with the light-sensor pair 112-3, provides a measure of the velocity of the ribbon 26 expressed as an angular velocity of the roller 112-1. There was some question as to whether this type of control of ribbon feed would work due to the complexities introduced by the changing diameters of the ribbon 26 on the ribbon supply spool 22 and the ribbon take-up spool 24. Because some of the traditional ways of making such calculations entail the use of the mathematical term "pi" (3.1416), there was some doubt as to whether an eight bit processor, for example, would have enough processing time to perform the necessary calculations for the associated printing speed.

Before discussing the equations used in determining the number of steps required of the stepping motor 104, it is useful to discuss the factors used in the calculations. The following definitions apply:

Ec=Encoder constant, the number of pulses per rotation of timing disc 112-2.

Fd=Feed distance, amount of ribbon 26 fed at print station 28 for each cycle of printing; (0.115 inch) in the embodiment described.

Fst=Number of steps of motor 104 which are required to feed the "feed distance".

Gr=Gear ratio; this is the ratio of teeth 103 on the take-up spool to teeth on the driving gear 102.

Mr=Motor step rate (steps per second) for motor 104.

Msp=Media speed (linear velocity of media at the print station 28.

PPF=Number of timing pulses from timing disc 112-3 which translates into the linear displacement of the required amount of ribbon 26 at the print station 28.

Rr=Radius of roller 112-1.

Rs=Radius of ribbon 26 on the take-up spool 24.

Smr=Number of steps per revolution of the stepping motor 104; in the embodiment described, the number is 200.

Ssr=Number of steps of stepping motor 104 to rotate the take-up spool 24 one complete revolution.

T=Time between successive pulses coming from the light sensor pair 112-3 associated with the timing disc 112-2.

Url=Angular or rotational speed of the roller 112-1.

Usp=Angular or rotational speed of the take-up spool 24.

Pi=Circular constant (3.1416).

Having defined the terms to be used hereinafter, it now seems appropriate to discuss the method and apparatus used in controlling the media movement at the print station 28. Certain relationships exist among the different elements used in the apparatus 10. These relationships can be expressed as follows:

$$PPF = \frac{Ec * Fd}{(2 * Pi * Rr)} \quad \text{(EQ. 1.)}$$

$$Ssr = Smr * Gr \quad \text{(EQ. 2.)}$$

$$Usp = \frac{Mr}{Ssr} \quad \text{(EQ. 3.)}$$

$$Msp = Usp * 2 * Pi * Rs; \quad \text{(EQ. 4.)}$$

media speed derived from roller 112–1.

$$Msp = Ur1 * 2 * Pi * Rr; \quad \text{(EQ. 5.)}$$

rotational speed of roller 112–1.

$$Ur1 = \frac{1}{(Ec * T);}; \quad \text{(EQ. 6.)}$$

this implies that the media speed which follows is:

$$Msp = \frac{2 * Pi * Rr}{(Ec * T);}; \quad \text{(EQ. 7.)}$$

Equating the media speed equations EQ. 4 and EQ. 7;

$$Usp = 2 * Pi * Rs = \frac{2 * Pi * Rr}{(Ec * T)}; \quad \text{(EQ. 8.)}$$

or $$Usp * Rs = \frac{Rr}{(Ec * T)}. \quad \text{(EQ. 9.)}$$

Because the rotational velocity of take-up spool 24 is constant, and Rr Ec are known to be constant, this implies that:

$$Rs = \frac{K}{T}; \quad \text{(EQ. 10.)}$$

that is, the diameter of the ribbon 26 on the take-up spool 24 is inversely proportional to the time taken for one pulse from the timing disc 112-2.

Because what is required is the number of steps of the stepping motor 104 to move the ribbon 26 the predetermined distance at the print station 28, EQ. 10 must be extended.

$$Fst = \frac{Fd * Ssr}{(2 * Pi * Rs)}; \quad \text{(EQ 11.)}$$

solving for Rs, $$Rs = \frac{Fd * Ssr}{(2 * Pi * Fst)}; \quad \text{(EQ. 12).}$$

substituting in EQ. 9., $$\frac{Usp * Fd * Ssr}{(2 * Pi * Fst)} = \frac{Rr}{(Ec * T)}; \quad \text{(EQ. 13.)}$$

cross multiplying:

$$2*Pi*Rr*Fst = Usp*Fd*Ssr*Ec*T; \quad \text{(EQ. 13.)}$$

Solving for Fst:

$$Fst = T * \frac{(Usp * Ssr * Ec * Fd)}{(2 * Pi * Rr)}; \quad \text{(EQ. 15.)}$$

or $$Fst = T * Usp * Ssr * PPF. \quad \text{(EQ. 16)}$$

By selecting an "appropriate" cruise speed for stepping motor 104 which is reasonable from a performance point of view, EQ. 16 can be simplified, greatly, as follows: If a motor speed for stepping motor 104 is selected as follows:

$$Mr = \frac{1}{(PPF * 64)}: \quad \text{(EQ. 17.)}$$

Then, EQ. 3. becomes:

$$Usp = \frac{1}{(PPF * Ssr * 64)}; \quad \text{(EQ. 18.)}$$

Substituting EQ. 18 into EQ. 16 and cancelling like terms:

$$Fst = \frac{T}{64}. \quad \text{(EQ. 19.)}$$

From EQ. 19, it is apparent that the motor steps required to feed the media (ribbon 26) at the print station 28 is equal to T divided by 64 which is a predetermined number for the embodiment described. In other words, the controller 38 must only divide the period (T) of the roller 112-1 by 64 to determine the number of steps by the stepping motor 104 required to feed the ribbon 26 at the print station 28 in the embodiment described.

A feature of the present invention is that it was discovered that there is a direct correlation between the velocity of the ribbon 26 at the velocity sensor 112 and the number of steps which the stepping motor has to be indexed in order to increment the ribbon by the required amount at the print station 28. For example, when the diameter of ribbon 26 on the ribbon supply spool 22 is large (for a new roll), and the diameter of the ribbon 26 on the take-up spool 24 is small, the controller 38 indexes the stepping motor about 45 steps, in the embodiment described, in order to advance the ribbon 26 at the print station 28 for the predetermined increment of 0.115 inches. When the diameter of ribbon 26 on the take-up spool 24 is large, each index of the stepping motor 104 will move the ribbon 26 at a faster velocity at the velocity sensor 112 when compared to a time when the diameter of ribbon 26 on the take-up spool is small. When the diameter of ribbon 26 on the take-up spool is large, about 15 steps or indexes of the stepping motor 104 are required to increment the predetermined amount of ribbon 26 at the print station 28.

When a new roll of ribbon 26 is placed on the supply spool 22 and the take-up spool 24 is "empty", the controller 38 feeds about ½ inch of ribbon 26 to make sure that an initial accurate reading of velocity is obtained from the velocity sensor 112. The initial velocity reading is then used by the controller 38 in equation EQ. 19 to obtain the number of steps required to feed the ribbon 26 at the print station 28. Printing is then effected on the document 14 at the print station 28, and a new document 14, for example, is then positioned at the print station 28 to repeat the process. After each printing, the output of the velocity sensor 112 is used to calculate the number of steps which are required of the stepping motor 104 in order to increment the ribbon 26 the calibrated or predetermined amount at the print station 28. The controller 38 may do some averaging of the number of steps required to index the stepping motor 104 after a new roll of ribbon 26 is installed so as to provide a gradual change in the number of steps required. Also, if there is a break in the ribbon 26, there may be quite a change in the number of steps required. Whenever there is a sudden jump in the number of steps required of the stepping motor 104, the controller 38 may stop the printing operation and indicate to the associated operator that there is a possible break in the ribbon 26 which should be checked.

Figure 11:
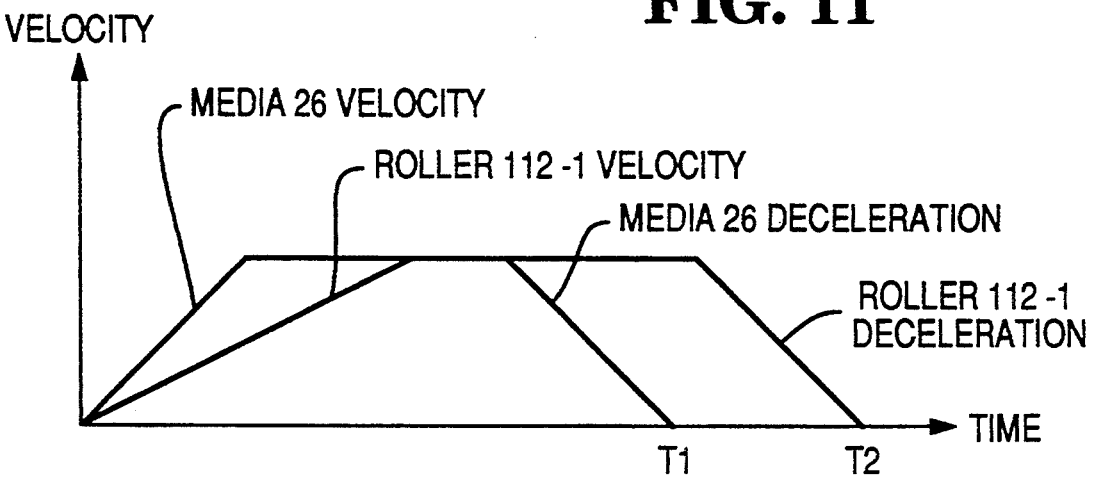
FIG. 11 is a diagram showing a relationship of velocities between certain elements in the elements shown in FIG. 2.

Another feature of this invention is that it minimizes the slippage problems which are usually associated with systems which use metering rollers for gauging the amount of media to be fed to a work station, like a print station, for example. When the metering roller was used, the metering roller had more inertia than the media, and consequently, the media reached its accurate velocity before the roller reached its accurate velocity as shown in FIG. 11. Because there is less inertia in the roller 112-1 and the timing disc 112-2 compared to known metering rollers which are driven, the roller 112-1 provides a good correlation of ribbon velocity and angular velocity of the roller 112-1.

What is claimed is:

1. An apparatus comprising:

a print station;

a ribbon supply means including a ribbon supply spool having unused ribbon wound thereon for supplying unused ribbon to said print station as ribbon is unwound from said ribbon supply spool;

a ribbon take-up means including a ribbon take-up spool for winding thereon used ribbon supplied to said print station from said supply spool, and for providing equal increments of ribbon to said print station as the used ribbon on said ribbon take-up spool gets larger and the amount of unused ribbon on said ribbon supply spool gets smaller;

said ribbon take-up means comprising:

a stepping motor coupled to said take-up spool for rotating said take-up spool at a substantially constant angular velocity in stepped increments;

a velocity sensor including a roller positioned between said print station and said take-up spool for sensing the velocity of said ribbon as said ribbon is wound on said ribbon take-up spool by expressing the velocity of the ribbon as a time period T for an angular displacement of said roller over which the ribbon passes; and processor means for dividing said time period T by a predetermined number N for providing a required number of stepped increments to said stepping motor for rotating said take-up spool to provide a fixed amount of unused ribbon to said print station as the used ribbon is wound on said ribbon take-up spool.

2. The apparatus as claimed in claim 1 in which said velocity sensor comprises:

said roller engaging said ribbon to be rotated thereby and having a timing disc coupled thereto to provide successive time periods for equal angular displacements as said roller is rotated by said ribbon.

3. The apparatus as claimed in claim 2 in which said ribbon supply spool and said ribbon take-up spool are the same size.

4. The apparatus as claimed in claim 3 in which said timing disc and said roller engaging said ribbon are light weight relative to said ribbon to enable a correlation between ribbon velocity of said ribbon between said print station and said take-up spool and angular velocity of said roller.

5. The apparatus as claimed in claim 4 in which said predetermined number is 64 and in which said unused ribbon is supplied to said print station in equal increments.

6. A method for providing equal increments of ribbon to a print station as the amount of ribbon on a ribbon supply spool gets smaller and correspondingly, the amount of ribbon on a ribbon take-up spool gets larger; said method comprising the steps of:

(a) using a stepping motor to incrementally rotate the ribbon take-up spool at a substantially constant angular velocity;

(b) sensing the velocity of said ribbon between said print station and said ribbon take-up spool and expressing said velocity of said ribbon passing over a roller as a time period T;

(c) using a processor to divide said time period T by a predetermined number to provide a number of steps required to index said stepping motor so as to present an equal increment of ribbon to said print station as the amount of ribbon on said take-up spool gets larger and the amount of ribbon on said supply spool gets smaller; and (d) energizing said stepping motor said number of steps.

7. A method for providing equal increments of ribbon to a print station as the amount of ribbon on a ribbon supply spool gets smaller and correspondingly, the amount of ribbon on a ribbon take-up spool gets larger; said method comprising the steps of:

(a) using a stepping motor to incrementally rotate the ribbon take-up spool at a substantially constant angular velocity;

(b) using the movement of said ribbon between said print station and said ribbon take-up spool to express a time period T for a predetermined angular displacement of a ribbon metering roller;

(c) dividing the time period T by a predetermined number N on a processor to arrive at a number of stepped increments the stepping motor has to index said ribbon take-up spool to provide a said equal increment of ribbon to said print station as the amount of ribbon on the take-up spool gets larger and the amount of ribbon on the ribbon supply spool gets smaller; and (d) energizing said stepping motor said number of steppe increments.

8. The method as claimed in claim 7 in which said using step (b) is effected by:

(b-1) moving said ribbon over a metering roller apparatus including said ribbon metering roller to provide outputs for equal angular displacements, with said time period T being determined by two successive outputs from said metering roller apparatus.

9. A method for providing equal increments of ribbon to a print station as the amount of ribbon on a ribbon supply spool gets smaller and correspondingly, the amount of ribbon on a ribbon take-up spool gets larger; said method comprising the steps of:

(a) using a stepping motor to incrementally rotate the ribbon take-up spool at a substantially constant angular velocity;

(b) using the movement of said ribbon between said print station and said ribbon take-up spool to rotate a roller and to express a time period T for a predetermined angular displacement of said roller;

(c) dividing the time period T by a predetermined number N on a processor to arrive at a number of stepped increments the stepping motor has to index to provide a said equal increment of ribbon to said print station;

(d) energizing said stepping motor said number of stepped increments; and (e) repeating steps (a), (b), (c), and (d) for the remainder of the ribbon on said ribbon supply spool.

10. The method as claimed in claim 9 in which said using step (b) is effected by:

(b-1) moving said ribbon over said roller to provide outputs for equal angular displacements, with said time period T being determined by two successive outputs from said roller.

* * * * *